US009404284B2

(12) United States Patent
Stendal

(10) Patent No.: US 9,404,284 B2
(45) Date of Patent: Aug. 2, 2016

(54) SHAFT ARRANGEMENT FOR A LOCKING DEVICE AND A LOCKING DEVICE

(75) Inventor: Jan Stendal, Vasteras (SE)

(73) Assignee: Stendals El AB, Vasteras (SE)

( * ) Notice: Subject to any disclaimer, the term of this patent is extended or adjusted under 35 U.S.C. 154(b) by 100 days.

(21) Appl. No.: 14/116,504

(22) PCT Filed: Apr. 11, 2012

(86) PCT No.: PCT/SE2012/050389

§ 371 (c)(1),
(2), (4) Date: Nov. 8, 2013

(87) PCT Pub. No.: WO2012/154108

PCT Pub. Date: Nov. 15, 2012

(65) Prior Publication Data

US 2014/0084601 A1 Mar. 27, 2014

(30) Foreign Application Priority Data

May 9, 2011 (SE) ..... 1150405

(51) Int. Cl.

| | |
|---|---|
| ***E05B 3/00*** | (2006.01) |
| ***E05B 13/00*** | (2006.01) |
| ***E05B 15/00*** | (2006.01) |
| ***E05B 3/04*** | (2006.01) |
| ***E05B 63/16*** | (2006.01) |

(Continued)

(52) U.S. Cl.

CPC ..... *E05B 15/0033* (2013.01); *E05B 3/04* (2013.01); *E05B 3/08* (2013.01); *E05B 13/005* (2013.01); *E05B 15/0013* (2013.01); *E05B 63/16* (2013.01); *E05C 1/16* (2013.01); *E05B 13/002* (2013.01); *E05B 47/0676* (2013.01); *E05B 53/003* (2013.01); *Y10T 292/1022* (2015.04)

(58) Field of Classification Search

CPC ..... E05B 3/04; E05B 3/08; E05B 63/16
USPC ..... 292/347, 348, 358, 359
See application file for complete search history.

(56) References Cited

U.S. PATENT DOCUMENTS 294,881 A * 3/1884 Jones ..... 292/348
529,887 A * 11/1894 Wardwell ..... 292/351

(Continued)

FOREIGN PATENT DOCUMENTS

DE 949275 * 9/1956
DE 2257681 * 5/1974

(Continued)

OTHER PUBLICATIONS

International Search Report mailed Jul. 4, 2012 during examination of International Application No. PCT/SE2012/050389.

*Primary Examiner* — Carlos Lugo
(74) *Attorney, Agent, or Firm* — Norton Rose Fulbright US LLP

(57) ABSTRACT

The invention relates to a locking device comprising a rotatable shaft coupling (19, 63) provided with a hollow (21, 65) and a shaft arrangement (3, 61) comprising a shaft (25, 71) arranged in the hollow and which connects the shaft and the shaft coupling so that they are jointly rotatable for transmission of at least one rotational movement or rotational force between the shaft and the shaft coupling. The invention also relates to a shaft arrangement (3, 61) shaped to be connected with a locking device comprising a rotatable shaft coupling provided with a hollow.

12 Claims, 3 Drawing Sheets

Figure 1A:
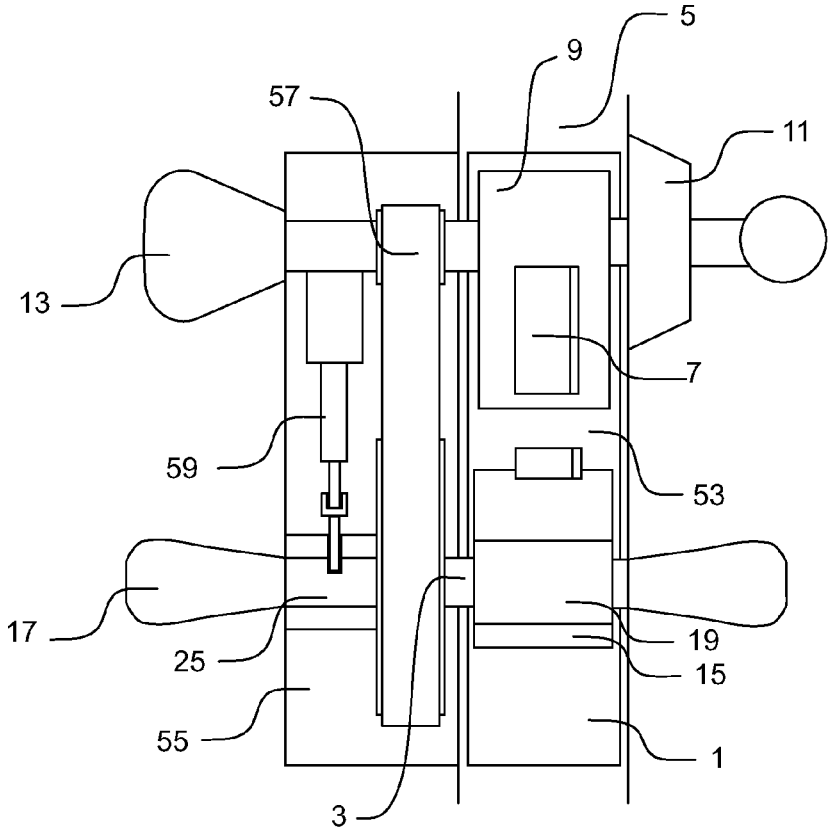

(51) Int. Cl.

| | |
|---|---|
| ***E05B 3/08*** | (2006.01) |
| ***E05C 1/16*** | (2006.01) |
| *E05B 47/06* | (2006.01) |
| *E05B 53/00* | (2006.01) |

(56) References Cited

U.S. PATENT DOCUMENTS

| | | | | | |
|---|---|---|---|---|---|
| 734,117 | A | * | 7/1903 | Caley | 292/358 |
| 1,970,758 | A | * | 8/1934 | Lyons et al. | 292/358 |
| 4,728,133 | A | * | 3/1988 | Valley | 292/336.3 |
| 5,026,101 | A | * | 6/1991 | Dotterweich et al. | 292/166 |
| 5,509,174 | A | * | 4/1996 | Worrell | 16/441 |
| 5,598,726 | A | * | 2/1997 | Cordle | 70/224 |
| 5,788,296 | A | * | 8/1998 | Kuo et al. | 292/358 |
| 5,794,472 | A | | 8/1998 | Kester et al. | |
| 5,865,050 | A | * | 2/1999 | Michaud et al. | 70/416 |
| 6,014,878 | A | | 1/2000 | Shen | |
| 6,101,856 | A | | 8/2000 | Pelletier et al. | |
| 6,264,255 | B1 | * | 7/2001 | Fortune | 292/336.3 |
| 6,357,270 | B1 | | 3/2002 | Vazquez | |
| 6,869,116 | B2 | * | 3/2005 | Dalsing | 292/358 |
| 7,686,357 | B2 | * | 3/2010 | Engel et al. | 292/347 |
| 7,900,978 | B2 | * | 3/2011 | Zimmer | 292/100 |
| 8,161,780 | B1 | * | 4/2012 | Huml | 70/107 |

FOREIGN PATENT DOCUMENTS

| | | | |
|---|---|---|---|
| DE | 2526218 | | * 12/1976 |
| EP | 1484462 | A1 | 12/2004 |
| GB | 2276657 | A | 10/1994 |
| GB | 2291464 | A | 1/1996 |

* cited by examiner

SHAFT ARRANGEMENT FOR A LOCKING DEVICE AND A LOCKING DEVICE

CROSS-REFERENCE TO RELATED APPLICATIONS

This application claims the benefit of International Application No. PCT/SE2012/050389 filed on Apr. 11, 2012 which claims priority to Sweden Application No. 1150405-7 previously filed on May 9, 2012, both of which are incorporated herein by reference in their entity.

TECHNICAL FIELD

The present invention relates to a shaft arrangement comprising a shaft and which is shaped to be connected with a locking device. The invention also relates to a locking device comprising such a shaft arrangement.

PRIOR ART

Locking devices for locking objects in the form of doors, hatches, gates, ports and similar usually comprises one or more bolts extending between the object to be locked and an adjoining element, such as a door jamb, to hold the object immovable. Such locking devices are normally shaped to be equipped with or be connected with a lock operating knob, a lock, such as a cylinder lock which can be locked or unlocked mechanically with a key, or one or more handles for retracting, projecting, locking and/or unlocking the one or more bolts.

A locking device usually comprises a plurality of movable, internal parts to achieve the function of the locking device, such as shafts, links, springs etc. One problem with such locking devices is that the mechanism within the locking device may become very complicated. Another problem with such locking devices is that it may sometimes be desirable to be able to change the function of a given locking device in hindsight. In particular it may be desirable to change a construction comprising two connected and jointly movable links and which are shaped to transfer a force or movement relative to each other, in such a way that the links also allow unrestricted movements.

SUMMARY OF THE INVENTION

One purpose with the present invention is to indicate a mechanical construction that allows that a function of a locking device can be changed in hindsight in a simple way due to introduction of the construction.

Another purpose with the present invention is to show a mechanical construction for a locking device having the ability to allow a limited movement between a first and a second part, which parts also are capable to be in a force transmitting engagement with each other for transmitting a movement there between.

Another purpose with the present invention is to achieve a mechanical construction for a locking device allowing transmission of a force between and a joint rotation of a first and second part, and which also allows unrestricted rotation of the parts relative each other.

Another purpose of the present invention is to achieve a mechanical construction for a locking device allowing that a handle connected with the locking device and which is shaped to retract the bolt with an opening movement, also is rotatable in a direction opposite the opening movement without affecting the bolt.

At least one of these purposes is achieved with the shaft arrangement and with the locking device according to the attached independent claims.

According to a first aspect of the invention a shaft arrangement is provided designed to be connected with a locking device comprising a rotatable shaft coupling provided with a hollow, which shaft arrangement comprises a shaft shaped to be arranged in the hollow and to connect the shaft and the shaft coupling so that they are jointly rotatable for transmission of at least one rotational movement or rotational force between the shaft and the shaft coupling.

According to a second aspect of the invention a locking device is provided which comprises a rotatable shaft coupling provided with a hollow and a shaft arrangement comprising a shaft arranged in the hollow and which connects the shaft and the shaft coupling so that they are jointly rotatable for transmission of at least one rotational movement or rotational force between the shaft and the shaft coupling.

By shaping the shaft to create a play in the hollow, which play allows a disengaged rotation of the shaft inside the hollow, the shaft may be rotated relative to the shaft coupling within the framework of the play, while still allowing rotational forces to be transmitted between the shaft and the shaft coupling. Thus it is achieved that a rotational force may be transmitted between the shaft and the shaft coupling along at least one first, common movement path or direction, while the shaft and/or the shaft coupling may also be rotated independently of each other along at least a second movement path or direction. Thus versatility for the construction is achieved, which may alleviate the formation of a locking device or of a device intended to be connected to a locking device. In particular, the formation of a locking device comprising a handle and at least one bolt that may be retracted with an opening movement of the handle is alleviated, wherein a shaft arrangement connected between the handle and the bolt allows the handle to be rotated in a direction opposite the opening direction without affecting the bolt. The play preferably allows a limited rotation of the shaft in the shaft coupling without the rotation being transmitted to the shaft coupling. According to an alternative embodiment the shaft coupling may of course also be shaped to contribute to the play.

A shaft is usually rotatable around a rotational axis extending along the length direction of the shaft. The shaft is usually shaped for transmission of a rotational movement between two external elements or external links, for example a shaft coupling, alternatively for transmission of a rotational movement from a first to a second end of the shaft. Such a shaft can comprise an elongated rod, usually straight, but possible provided with some form of angle or universal joint. A shaft is usually manufactured in a stiff material, such as metal, to reduce torsion. A shaft coupling is in turn preferably also rotatable and shaped to be connected to the shaft for transmission of a rotation between the shaft and the shaft coupling. The rotation may be transmitted in one or two rotational directions, of course with the exception for when the shaft moves within the play, and the rotation may be transmitted from the shaft to the shaft coupling or the other way round from the shaft coupling to the shaft depending on desired functionality and positioning in the locking device. Preferably, the shaft coupling is rotatable around the same rotational axis as the shaft. The shaft coupling may comprise a rotatable sleeve with a hollow, wherein the shaft is arranged to run inside the hollow and the sleeve engages with the shaft for transmission of said rotation.

Preferably the play is formed between the shaft and the shaft coupling. Preferably the play comprises a space within which the shaft may be turned within the hollow of the shaft coupling. Preferably the play is shaped as an empty space creating a distance between the force transmitting parts of the shaft and the shaft coupling. Preferably the shaft may be turned unrestrictedly within the space of the play, wherein the shaft and the shaft coupling avoids transmitting a rotation between the shaft and the shaft coupling. Thus the shaft may be rotated relative to the shaft coupling within the space while the shaft coupling remains immovable. Alternatively the shaft coupling can also be rotated unrestrictedly around the shaft a distance corresponding to the play while the shaft remains immovable. Preferably the play is then shaped to provide a clear path for rotation of the shaft and the shaft coupling relative to each other. Thus the shaft and the shaft coupling avoids to affect or to be affected by each other with an opposite rotational force during a rotation that remains within the play.

Preferably the shaft is also shaped to begin a transmission of a rotational movement to the shaft coupling when the shaft strikes an end of the play. The shaft is thus limited to be rotatable a distance corresponding to said play within the hollow, after which the shaft and the shaft coupling are in force transmitting connection with each other. Of course the shaft coupling could also transmit a force to the shaft in a corresponding manner when the shaft coupling is rotated until an end of the play strikes the shaft. Thus the function of the shaft arrangement of being able to transmit a force between the shaft and the shaft coupling is guaranteed. In that the function with an opportunity of both joint and individual rotation is achieved with a simple shaft arrangement provided with a play rather than with some other form of construction it becomes much easier to install and utilise the construction in a locking device. Furthermore, the shaft arrangement according to the invention does not occupy more space inside the locking device than a corresponding shaft arrangement of the prior art, wherein a former shaft may easily be replaced with the shaft arrangement according to the invention. Thus it is also easier and less expensive to achieve this desired function in a previously known locking device missing the function, without necessitating large alterations in its construction. The construction of the locking device may be shaped to keep the shaft coupling (or the shaft) locked in a particular direction of rotation. Due to the shaft arrangement and the play the shaft (or the shaft coupling) may thus still be rotated in that direction, at least a distance corresponding to the play, after which the shaft (or shaft coupling) also becomes locked from further rotation.

According to one embodiment the shaft comprises a longitudinal groove arranged to at least in part form said play. Such a groove is simple to manufacture and adapt in accordance with the present needs of the locking device. The outside of a shaft is usually easier to shape than the inside of a shaft coupling, wherein the cost of manufacturing the shaft arrangement becomes lower. The groove may easily be adapted to provide a clear path for the rotation of the shaft in the shaft coupling dependent on a desired length for the clear movement path between the shaft and the shaft coupling by increasing or decreasing the width of the groove, respectively. Furthermore, the desired angle position between the shaft and the shaft coupling may easily be obtained by selecting and adapting the position for the groove on the shaft. Another advantage with creating the play through such a groove in the shaft is that many locking devices are provided with shaft couplings with a given standard. Thus the standard shaft coupling may be retained while the easily adaptable shaft is shaped to achieve the play according to the invention. Hence, the cost for the shaft arrangement decreases since the shaft coupling is maintained unchanged in the locking device. I particular, if the shaft arrangement is adapted for connection of a handle to a locking device, the shaft is usually easily removable from the locking device, wherein the shaft may be modified or replaced in order to achieve the desired function without even having to remove the locking device from its present location.

According to one embodiment the groove is wedge shaped. Preferably the wedge shaped groove is lined with at least one, preferably two contact surfaces adapted for transmission of a rotation or rotational force between the shaft and the shaft coupling. Thus the contact surface (surfaces) is/are angled in accordance with the angle of the wedge. Preferably the contact surface (surfaces) is/are angled so that the contact surface substantially bear straight and flatly against a corresponding contact surface of the shaft coupling during a joint rotation of the shaft and the shaft coupling. Thus the wear of the contact surface decreases, which is important since a locking device must last during a long time.

According to one embodiment the shaft arrangement comprises an intermediate element arranged inside said hollow and next to the shaft in connection with the play. Depending on the shape of the hollow and the shaft it may be more or less simple to achieve a suitable play. By positioning an intermediate element in the hollow there are better possibilities of shaping the shaft arrangement so that it fits a given locking device. The manufacturing may also be performed with fewer or simpler operations in the construction or shape of the shaft and shaft coupling. Preferably the intermediate element is arranged movable in relation to the shaft within the hollow. Preferably the intermediate element is its own, separate element relative to the shaft and the shaft coupling. Preferably the intermediate element is arranged lying loosely inside the hollow in connection with the play. Thus the intermediate element may move inside the hollow relative to the shaft, which may lead to an increased movability for the shaft relative to if the intermediate element had been stiffly integrated with the shaft or shaft coupling. Preferably the intermediate element is also arranged to bear both against a contact surface of the shaft coupling and against a corresponding contact surface of the shaft in a force transmitting manner in order to allow a transmission of said rotational movement between the shaft coupling and the shaft when the shaft has been rotated to the end of the play. Thus the shaft and the shaft sleeve may be rotated jointly when the intermediate element strikes an end of the play.

According to one embodiment the shaft arrangement comprises at least one polygon corner (vertex) shaped to couple the shaft with the shaft coupling for transmission of the at least one rotational movement or rotational force. Polygon corners (vertices) allow rotationally fixed engagement between the shaft and the shaft coupling in a manner that decreases wear. In one embodiment the intermediate element comprises at least one such polygon corner. In a preferred embodiment the hollow of the shaft coupling also comprises a cross sectional shape comprising at least one polygon corner shaped to simplify engagement with the shaft. In another embodiment the shaft may instead be provided with such a polygon corner if the shaft arrangement is without an intermediate element.

BRIEF DESCRIPTION OF THE ATTACHED DRAWINGS

The invention is now to be described as a number of non-limiting examples of the invention and with reference to the attached drawings.

FIG. 1*a* shows a first embodiment of a locking device according to the invention.

Figure 1B:
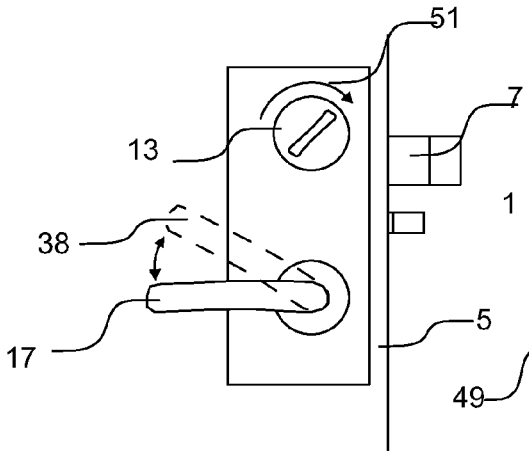
Figure 1C:
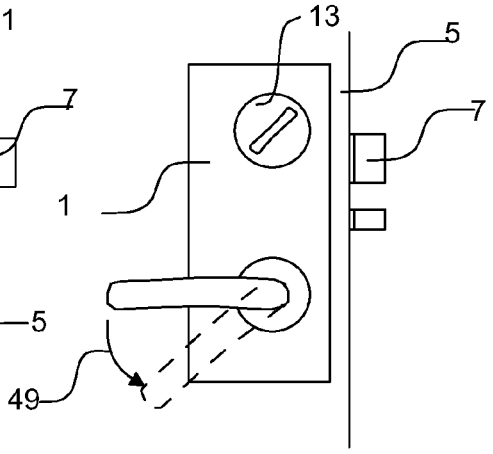

FIG. 1*b-c* shows the locking device and possible rotational directions for the handle.

FIG. 1*d-g* shows a shaft arrangement comprising a shaft and a shaft coupling according to the invention and which is designed to be connected with the locking device.

Figure 2B:
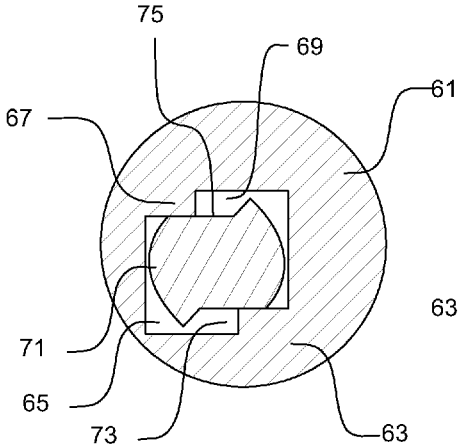
Figure 2A:
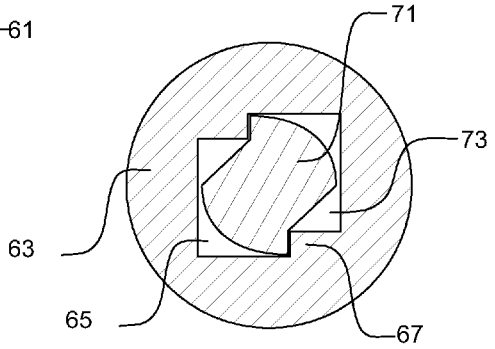

FIG. 2*a-b* shows yet another example of a shaft arrangement according to the invention.

DETAILED DESCRIPTION

Figure 1D:
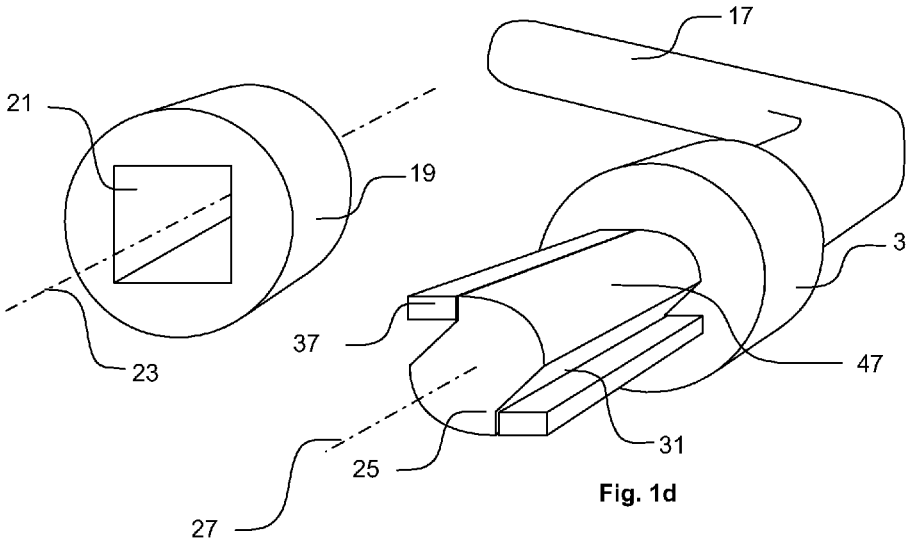
Figure 1E:
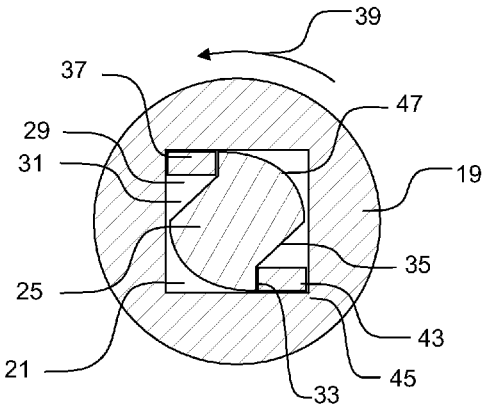
Figure 1F:
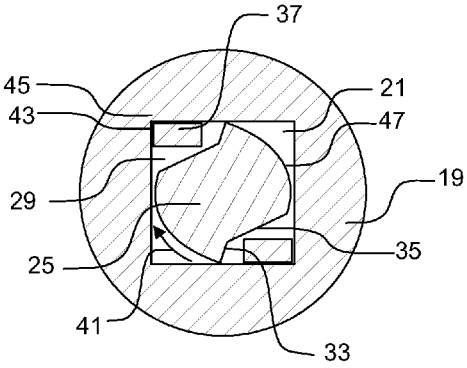

In FIG. 1*a* one example of a locking device 1 comprising a shaft arrangement 3 according to the invention is shown. The locking device is designed to be provided inside or in association with an object 5, such as a door leaf, in order to keep the object closed and/or locked. The locking device comprises at least one retractable bolt 7 adapted to lock and/or keep the object closed. The locking device further comprises a locking mechanism 9 connectable to an external lock 11 and/or a lock operating knob 13, designed to lock or unlock the bolt 7 and a mechanism 15 intended to be connected to at least one, but normally two, handles 17 to allow retraction of the bolt 7 in response to an opening movement from one of the handles. The mechanism 15 is in this example constructed to comprise the shaft arrangement 3 according to the invention. In FIGS. 1*d-f* the shaft arrangement arranged inside the locking device 1 is shown in closer detail. Even if the shaft arrangement 3 in FIGS. 1*d*-1*f* in this example is arranged inside the locking device it could just as well be provided separately as a separate shaft arrangement suitable to be connected at a later stage with the locking device or with some other form of locking device.

The shaft arrangement 3 comprises a shaft coupling 19 provided with a hollow 21. The shaft coupling 19 is in this example shaped to constitute a part of the mechanism 15 in the locking device, which mechanism is designed to allow a retraction of the bolt 7 upon rotation of the shaft coupling 19 around a rotational axis 23 running along and in the centre of the hollow. The shaft arrangement further comprises a shaft 25 shaped to be arranged in and be housed inside the hollow for connecting the shaft 25 and the shaft coupling 19. In this example the shaft of the shaft arrangement is connected to a handle 17 with a first end and shaped to be connected with the shaft coupling 19 with a second end. The shaft is rotatable around its own length axis 27, which, after assembly of the shaft into the shaft coupling 19, coincides with the rotational axis of the shaft coupling, wherein the shaft and the shaft coupling 19 are jointly rotatable for transmission of at least one rotational movement or rotational force between the shaft and the shaft coupling. The shaft arrangement 3 is thus designed to transmit a rotational movement from the handle to the shaft coupling in order to achieve the retraction of the bolt with the handle, which is also illustrated in FIGS. 1*b-c*.

The shaft 25 is further shaped to form a play 29 inside the hollow 21, which play is shaped to allow rotation of the shaft inside the hollow. The play 29 is in this example shaped to allow a disengaged rotation of the shaft inside the hollow, wherein a transmission of a rotation or rotational force between the shaft 25 and the shaft coupling 19 is avoided. In this example the play 29 comprises a space within which the shaft may be rotated inside the hollow of the shaft coupling. The play is thus shaped to provide a clear path for the shaft so that the shaft and the shaft coupling can be rotated relative to each other. Hence the shaft and the shaft coupling may be rotated relative to each other along a first movement path without a movement being transmitted between the shaft and the shaft coupling, while they may still be rotated jointly with each other in connection with a transmission of such a rotational force along a second movement path.

In this example the play 29 is achieved by the shaft being provided with a groove 31, which forms the empty space within the hollow. The groove 31 is shaped to extend along the shaft, in particular along the part of the shaft 25 which is housed within the hollow 21. It is sufficient that the groove is only arranged along a part of the length of the shaft as long as the remaining parts of the shaft are shaped to avoid a rotation transmitting engagement with the shaft coupling. The groove 31 is in this example shaped with a wedge shaped cross section. The wedge shaped groove is lined with a first 33 and a second contact surface 35, respectively, which are substantially flat and arranged at an angle relative each other. The contact surfaces are also shaped to allow engagement with the shaft coupling 19 for transmission of a rotation or rotational force to the shaft coupling, as described below.

The shaft arrangement comprises at least one, in this example two, intermediate elements shaped to be arranged between the shaft and the shaft coupling inside the hollow. The intermediate element 37 is constituted by a separate element, separate from the axis, and is further arranged lying loosely in the hollow 21 beside the shaft in connection with the play, wherein the intermediate element 37 is also movable relative to the shaft. Thus the position and angle of the intermediate element 37 may change with the present angle or position of the shaft inside the hollow. The intermediate element 37 is also shaped to be in force transmitting connection with both the shaft 25 and the shaft coupling 19 in order to allow a transmission of a rotational movement or rotational force there between. In this example the intermediate element 37 is positioned in the groove, wherein the intermediate element limits the size of the play and thus the length of the rotation of the shaft in the hollow that may take place without the rotation being transmitted to the shaft coupling.

In FIG. 1*e* the shaft arrangement 3 is shown in a first state of the shaft arrangement, in which state the shaft 25 is rotated towards a first end position of the play, wherein the shaft is rotated as far as possible in a first direction 39 relative to the shaft coupling 19 (counter clockwise in the figure). The intermediate element 37 is in this state wedged between the shaft 25 and the shaft coupling 19, wherein the intermediate element is arranged to connect the shaft and the shaft coupling in a force transmitting manner in the first direction. More specifically the intermediate element 37 is wedged between the first contact surface 33 of the groove of the shaft and an inner side surface of the hollow of the shaft coupling.

On depression of the handle 17 when the shaft arrangement 3 is in the first state the shaft arrangement and the shaft 25 are induced to rotate further in the first direction 39. The first shaft 25 thus presses the intermediate element 37 against the shaft coupling, wherein the rotational force obtained from the handle is transmitted to the shaft coupling 19. In this example the contact surface 33 of the groove 31 is pressed against the side surface of the hollow. Thus the shaft coupling 19 is affected by the rotational force from the handle, wherein the handle, the shaft and the shaft coupling are jointly rotated, which in this example leads to a retraction of the bolt. This relationship is also shown if FIG. 1*c*.

During uplifting of the handle 17 when the shaft arrangement is in the first state the shaft 25 is rotated in a second, opposite direction (in this example clockwise) which moves the shaft through the play. This is more clearly shown in FIG. 1*f*. Thus the shaft 25 avoids transmitting any rotational movement or rotational force to the shaft coupling, wherein the shaft coupling remains unmoved. This in turn allows that the handle 17 may be lifted upwardly even if for example the locking device in general is designed to block such a clockwise rotation of the shaft coupling. The rotation of the shaft is allowed until the shaft has been rotated to the end of the play 29, wherein the shaft arrangement assumes a second state, which is shown in FIG. 1*g*.

Figure 1G:
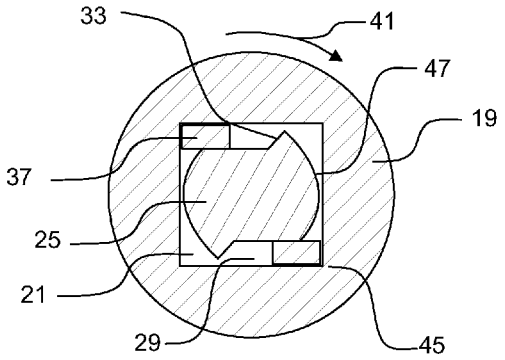

In FIG. 1*g* the shaft arrangement is shown in the second state, in which state the shaft is rotated to a second end position of the play 29. The shaft is in this example in the figure rotated as far as possible in the second direction (clockwise in the figure) relative to the shaft coupling, which second direction 41 is opposite the first direction. The intermediate element 37 is thus also in the second state wedged between the shaft and the shaft coupling, wherein the intermediate element is arranged to connect together the shaft and the shaft coupling in a force transmitting manner. More specifically, the intermediate element 37 is wedged between a second contact surface 35 of the groove of the shaft and a second, inner side surface of the hollow of the shaft coupling.

Upon continued rotation of the shaft arrangement in the second direction 41 when the shaft arrangement is in the second state the rotational force is as previously transmitted from the shaft 25 to the shaft coupling 19 via the intermediate element 37. The shaft coupling is thus rotated in the second direction under the condition that the locking device thus allows. I this example the shaft coupling 19 is however blocked against such a continued rotation in the second direction due to the construction of the locking device, wherein the shaft and the handle are also blocked against a continued movement. In this example a lifting of the handle 17 is blocked past a maximally lifted position 38, which is given by the length of the play. During rotation of the handle in the first direction when the shaft arrangement is in the second state the shaft is brought back through the play and back to the first state.

The play 29 is thus shaped to only allow a limited rotation of the shaft in the shaft coupling without the rotation being transmitted to the shaft coupling. The play, shaft and shaft coupling are thus shaped so that a transmission of a movement between the shaft and the shaft coupling is begun when the shaft strikes an end of the play. The shaft is limited to be rotatable a distance corresponding to said play within the hollow without transmitting a movement between the shaft and the shaft coupling. The allowed movement length can easily be adjusted by changing the length of the play, for example by changing the size of the groove or the size of the intermediate element.

The shaft 25 is in this example manufactured from a round rod of metal, in which two grooves 31 are machined on opposite sides of the shaft to create two spaces forming two plays 29 and room for two intermediate elements 37 arranged inside the space next to the plays. The shaft also comprises two rounded sliding surfaces 47 arranged to avoid engagement with the shaft coupling and positioned between the grooves. The hollows 21 of the shaft coupling 19 have in turn a mainly quadratic form and the two intermediate elements 37 have cross sections that are mainly rectangular.

The groove 31 is in this example mainly wedge shaped and lined by the two contact surfaces 33, 35 adapted to bear against the intermediate element 37 in the end positions of the shaft arrangement for transmission of a rotation or rotational force between the shaft and the shaft coupling. Due to the wedge shape the contact surfaces 33, 35 are angled, and since a wedge shape may easily be manufactured it is also simple to control the angles of the contact surfaces. In this example the contact surfaces are thus angled so that the contact surfaces mainly bear straight and flatly against the intermediate element 37 in the end positions of the shaft arrangement, which are shown in FIG. 1*e* and FIG. 1*g*.

The shaft arrangement further comprises at least one polygon corner 41, 43 shaped to connect the shaft and the shaft coupling for transmission of the at least one rotational movement or rotational force. In this example the intermediate element comprises such a polygon corner 41 in the form of a right angled corner. Correspondingly the hollow 21 of the shaft coupling also comprises a cross section shape comprising a segment comprises at least one polygon corner 43. Polygon corners have the advantage of being able to transfer a rotation and rotational forces at the same time of being resistant against wear.

In this example the locking device 1 is designed so that, when the door handle 17 is unaffected by outer forces, it induces the handle to assume a normal position for the handle in which the bolt is extended, which normal position is shown in FIG. 1*b*. Furthermore, the door handle is rotatable in an opening direction 49 for retraction of the bolt. The shaft arrangement is shaped to allow a rotation of the handle in a direction 51 opposite the opening direction of the door handle through said play 29, which is illustrated in FIG. 1*c*. The shaft arrangement is thus shaped to allow a rotation of the handle in a rotational direction opposite a rotational direction for retraction of the bolt and without the rotation being transferred to and affecting the bolt.

The locking device in FIG. 1*a* comprises in this example two parts, a first locking device part 53 arranged inside the door leaf, and a second part 55 in the form of an auxiliary device mounted onto the first part and on the inside of the door leaf. The auxiliary device 55, which in this example also comprises the shaft 25 and the handle 17, is adapted to, in a first state and on lifting up the handle, rotate the lock operating knob 13, so that the lock is opened and the locking device becomes unlocked. The auxiliary device 55 comprises for this purpose a band mechanism 67 connected to the shaft 25 and to the lock operating knob 13 with a band running there between for transmission of the rotation from the handle and the shaft to the lock operating knob. The auxiliary device further comprises a state control 59 arranged to control the auxiliary device 55 between the first state and a second state, in which the band mechanism 57 is disengaged so that the auxiliary device avoids transferring a rotation from the shaft to the lock operating knob. The state control is with advantage electronically controlled, wherein it is possible to transform a mechanical locking device part into an electromechanical locking device by mounting the auxiliary device 55 onto the locking device part 53.

In FIG. 2 another example of a design for a shaft arrangement 61 according to the invention is shown. The shaft arrangement is designed to transfer rotational movements between a first and a second part belonging to the locking device. The shaft arrangement 61 in FIG. 2*a-b* is designed in a corresponding manner as the locking arrangement 3 in FIG. 1*a-c*, but with the difference that the shaft arrangement 61 is without intermediate elements. Instead the hollow 65 of the shaft coupling 63 is shaped with a cross sectional shape comprising two projections 67 shaped to engage with the grooves 69 of the shaft 71 in the positions when a force transmission between the shaft and the shaft coupling is desired. The projections 67 are thus adapted to take over the function of the intermediate elements of the shaft arrangement in FIGS. 1*a-d*. The groove in the shaft forming the play 73 is here, as before, lined with two contacting surfaces 75 arranged to transfer said rotational movement and rotational force, respectively, between the shaft and the shaft coupling. In this example the contacting surfaces of the shaft is thus in direct contact with the shaft coupling and the projection of the shaft coupling during the transmission of the rotational movement or rotational force.

Another way in which the shaft arrangement may be provided with a shaft coupling and a shaft forming a play according to the invention is by letting either the shaft or the shaft coupling comprise a projecting pin arranged to run along a play in the form of a channel in the other of the shaft or the shaft arrangement. Yet another way is to let the hollow of the shaft and the circumference of the shaft comprise variable diameters in the form of one longer and one shorter diameter. Hence it leads to engagement when the shaft's longer diameter encounters the hollow's shorter diameter and disengagement when the shaft's longer diameter is rotated into an angle in which the diameter of the shaft coupling is longer. A man skilled in the art should also realise that a rotational movement can be transmitted in only one or in both directions relative to the play, and that the movement may be transmitted from the shaft to the shaft coupling as well as from the shaft coupling to the shaft, without departing from the principle for the invention.

Furthermore, the invention may be provided in the form of several different devices without departing from the principle of the invention. For example the invention may be provided in the form of a single shaft arrangement adapted to be connected, mounted or joined with a locking device later on, and which only comprises the shaft, only comprises the shaft coupling, and/or which comprises both a shaft and a shaft coupling. The invention can also be provided as a locking device comprising such a shaft arrangement, for example in the form of an auxiliary device, as a locking device part, as a combination of an auxiliary device and a locking device part, or as a traditional locking device which does not comprise an auxiliary device.

Furthermore, the shaft arrangement may in itself constitute a part of an internal mechanism in a locking device, alternatively the shaft arrangement may be a part of a device intended to be connected with a locking device, or be a component intended to be assembled into a locking device. Correspondingly the shaft coupling may such as in this example be intended to constitute a part of the locking device, but in another example the shaft coupling may instead constitute a part of the shaft arrangement and/or be assembled into the locking device together with assembly of the shaft arrangement.

The invention should not to be regarded as limited to the embodiments and examples shown, but rather a man skilled in the art could easily and freely vary the invention within the framework of the following claims. In particular the examples should be regarded as if they can be combined to span a space within which the invention may be varied rather than forming discrete examples.

The invention claimed is:

1. A shaft arrangement designed to be connected with a locking device (1) comprising a rotatable shaft coupling (19, 63) provided with a hollow section defining an inner surface (21, 65), said shaft arrangement (3, 61) comprises a shaft (25, 71) shaped to be arranged within the hollow section, the shaft comprises at least one rounded slide surface (47) shaped to avoid engagement with the inner surface of the hollow section;

a play (29, 73) is defined between the inner surface of the hollow section and the shaft (25, 71);

the shaft arrangement further comprises an intermediate element (37) shaped to be arranged within the play;

wherein, when a rotational movement or force is transmitted in a first direction, said shaft will engage the intermediate element (37) so that the shaft (25, 71) and the shaft coupling (19, 63) jointly rotate to transmit the movement or force to the locking device;

wherein, when a rotational movement or force is transmitted in a second direction, said shaft (25, 71) will not engage the intermediate element (37), the movement or force is not transmitted to the locking device and also allows disengagement of the shaft (25, 71) from the shaft coupling (19, 63).

2. A shaft arrangement according to claim 1 characterized in that the play (29, 73) comprises a space within which the shaft can be rotated within the hollow of the shaft coupling.

3. A shaft arrangement according to claim 1, characterized in that the shaft comprises a longitudinal groove (31, 69) shaped to at least in part form said play.

4. A shaft arrangement according to claim 3, characterized in that the groove (31, 69) comprises a wedge shaped cross-section.

5. A shaft arrangement according to claim 1, characterized in that the intermediate element (37) is shaped to be arranged between the shaft and the shaft coupling in a force transmitting manner at least when the shaft is rotated to an end of the play to allow a transmission of said rotational movement between the shaft coupling and the shaft.

6. A shaft arrangement according to claim 5, characterized in that the intermediate element (37) is substantially rectangular.

7. A shaft arrangement according to claim 5 or 6, characterized in that the intermediate element is shaped to be arranged lying loosely in the hollow, wherein a disengaged rotation of the shaft in the play is facilitated.

8. A shaft arrangement according to claim 1, characterized in that the shaft coupling comprises at least one polygon corner (43, 45) shaped to connect the shaft with the shaft coupling for transmission of the at least one rotational movement or rotational force.

9. A shaft arrangement according to claim 1, characterized in that the shaft arrangement (3) is designed to be connected between a door handle (17) and a bolt in the locking device which is retractable with the door handle, wherein the shaft arrangement is shaped to allow a rotation of the handle in a rotational direction (51) opposite an opening movement (49) from the handle in a rotational direction for retraction of the bolt (7) and without the rotation being transmitted to and affecting the bolt.

10. A locking device comprising a rotatable shaft coupling (19, 63) provided with a hollow section (21, 65) defining an inner surface;

a shaft arrangement (3, 61) comprising a shaft (25, 71) shaped to be arranged within the hollow section (21, 65), the shaft comprises at least one rounded slide surface (47) shaped to avoid engagement with the inner surface of the hollow section;

a play (29, 73) is defined between the inner surface of the hollow section and the shaft (25, 71); and an intermediate element (37) shaped to be arranged within the play (29, 73);

wherein, when a rotational movement or force is transmitted in a first direction, said shaft will engage the intermediate element so that the shaft and the shaft coupling jointly rotate to transmit the movement or force to the locking device;

wherein, when a rotational movement or force is transmitted in a second direction, said shaft (25, 71) will not engage the intermediate element (37), the movement or force is not transmitted to the locking device and also allows disengagement of the shaft (25, 71) from the shaft coupling (19, 63).

11. A locking device according to claim 10, characterized in that the play comprises a space inside which the shaft is rotatable within the hollow of the shaft coupling.

12. A locking device according to claim 10, characterized in that the locking device comprises at least one retractable bolt (7), and that the shaft arrangement is shaped to be connected to a door handle (17), wherein the play (29) of the shaft arrangement is shaped to allow a rotation of the door handle (17) in a direction (51) opposite an opening direction (49) from the door handle, which opening direction induces a retraction of the bolt.

* * * * *